US006746110B2

(12) United States Patent
Hayashi

(10) Patent No.: US 6,746,110 B2
(45) Date of Patent: Jun. 8, 2004

(54) LIQUID CONTAINER AND LIQUID SUPPLY SYSTEM

(75) Inventor: Hiroki Hayashi, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/137,390

(22) Filed: May 3, 2002

(65) Prior Publication Data

US 2002/0167573 A1 Nov. 14, 2002

(30) Foreign Application Priority Data

May 10, 2001 (JP) ..... 2001-139976
Apr. 26, 2002 (JP) ..... 2002-125908

(51) Int. Cl.[7] ..... B41J 2/175
(52) U.S. Cl. ..... 347/86; 347/85
(58) Field of Search ..... 347/84, 85, 86, 347/87, 92, 93

(56) References Cited

U.S. PATENT DOCUMENTS 5,621,446 A 4/1997 Tanaka et al. ..... 347/85
5,657,065 A * 8/1997 Lin ..... 347/93
5,784,088 A * 7/1998 Ujita et al. ..... 347/86
6,137,512 A * 10/2000 Higuma et al. ..... 347/86
2002/0012030 A1 1/2002 Okamoto et al.

FOREIGN PATENT DOCUMENTS

EP 1025998 8/2000
JP 04-110157 A * 4/1992 ..... 347/86
JP 2000-280492 10/2000
JP 2001-96761 4/2001

* cited by examiner

*Primary Examiner*—Anh T. N. Vo
(74) *Attorney, Agent, or Firm*—Fitzpatrick, Cella, Harper & Scinto

(57) ABSTRACT

A liquid container includes a container body; a liquid retaining member, provided in the container body, for absorbing and retaining liquid therein, the liquid retaining member having a surface to be contacted by a filter provided at a free end of liquid receiving means to supply the liquid to an outside, wherein the surface of the liquid retaining member is provided with pits and projections, the pits being out of contact with the filter, and the projections being contacted with the filter when the liquid retaining member and the filter are contacted.

14 Claims, 8 Drawing Sheets

LIQUID CONTAINER AND LIQUID SUPPLY SYSTEM

FIELD OF THE INVENTION AND RELATED ART

The present invention relates to a liquid container which is suitably usable as an ink container mountable to an ink jet recording apparatus and which has a portion to be contacted to a filter when the ink is supplied to the outside, and to a liquid supplying system using the liquid container.

In the field of an ink jet recording, an ink jet cartridge integrally having an ink jet head and an ink container and detachably mountable to a recording device is used since it is convenient from the standpoint of compactness and maintenance-free. Such ink jet cartridge is a type in which the ink jet head and the ink container are always integral, and a type in which the ink jet head and the ink container are separate and integrated upon use.

In either of the types, the ink ink container is capable of producing a negative pressure (back pressure) against the ink flow toward the ink jet head to stably supply the ink into t ink jet head during recording operation and to stably retain the ink.

In order to produced the negative pressure, the use is generally made with a porous material such as urethane foam as a negative pressure generation member (ink absorbing material) using the capillary force of the porous material as disclosed in Japanese Laid-open Patent Application Hei 8-230207.

Referring to FIG. 8, there is shown an example of a conventional ink container using the capillary force of the porous material.

The ink container 110 shown in FIG. 8 comprises a casing 111 constituting an ink accommodating portion 116 for accommodating ink, and an ink absorbing material 118 in the ink accommodating portion 116 to absorb and retain the ink by the capillary force. The casing 111 comprises an ink supply port 114 for supplying the ink from the ink container 110 to the ink jet head 121, and an air vent 112 for introducing the ambience into the ink accommodating portion 116 to accomplish smooth ink supply to the ink jet head 121. In the ink supply port 114, an ink leading member 119 which is an additional ink absorbing material is press-contacted to the ink absorbing material 118. The ink leading member 119 is made of a unidirectional bundle of filers extending in a direction from the ink absorbing material 118 to the ink supply port 114, and the capillary force (ink retaining force) is higher than that of the ink absorbing material 118. As a result, the ink is stably supplied to the portion around the ink supply port 114, so that in the ink supply to the ink jet head 121 is stabilized.

The supply of the ink from the ink container 110 to the ink jet head 121 is effected by contacting the ink receiving tube 122 connected to the ink jet head 121 to the ink leading member 119. Here, free end of the ink receiving tube 122 is provided with a filter 123 mounted thereto to prevent entering of the foreign matter and/or bubble into the ink jet head 121 through the ink receiving tube 122.

However, the ink container with which the ink is supplied to the outside by contact or abutment of the filter to the ink absorbing material which retains the ink by capillary force.

As described hereinbefore, the ink absorbing material disposed at t ink supply port, namely, the ink leading member is an aggregate of fibers, and the ink is supplied through between the fibers. In order to enhance the ink retaining force, the gaps between the fibers are small. On the other hand, the filter having fine openings are generally used in order to prevent entrance of the foreign matter into the ink jet head.

Referring to FIG. 9(*a*), when an average pitch P2' of the gap between the fibers of the ink leading member 114 in a plane of contact relative to the filter 123, is about mesh pitch P1' of the opening of the filter 123, fibers of the ink leading member 114 enter the openings of the filter 123 when the filter 123 and the ink leading member 114 are contacted to each other, as shown in FIG. 9(*b*). Therefore, the state is as if the filter had a finer mesh pitch P3' with the result of significant increase of the flow resistance against the ink.

With the recent increase of the recording speed of the ink jet recording apparatus, a high ink supply speed of the ink jet head is desired. The virtual existence of the structure impeding the ink flow in the ink supply path from the ink container to the ink jet head, the high speed recording of the ink jet recording apparatus is difficult. The foregoing analysis has been made with respect to the case of the ink absorbing material made of aggregate of the fibers. However, the analysis applies to the case of the porous material such as an urethane foam if the diameters of the pores of the porous material is considered as being the gaps between fibers. In the case that absorbing material absorbing and retaining the liquid is accommodated, and the absorbing material is contacted to the filter when the liquid is supplied to the outside, the same problem of ink supply arise when the liquid is to be supplied at high flow rate.

SUMMARY OF THE INVENTION

Accordingly, it is a principal object of the present invention to provide a liquid container and a liquid supplying system using the liquid container, in which an absorbing material absorbing and retaining the liquid is contacted by a filter when the liquid is supplied to the outside, and in which a stable supplying operation is possible even if the liquid is supplied at a high flow rate.

According to an aspect of the present invention, there is provided a liquid container comprising a container body; a liquid retaining member, provided in said container body, for absorbing and retaining liquid therein, said liquid retaining member having a surface to be contacted by a filter provided at a free end of liquid receiving means to supply the liquid to an outside, wherein said surface of said liquid retaining member is provided with pits and projections, the pits being out of contact with the filter, and the projections being contacted with the filter when said liquid retaining member and the filter are contacted.

According to the present invention, the contact region between the liquid holding member and the filter is limited because of the presence of the pits and projections on the surface of the liquid holding member relative to the filter. By this, the region where the flow resistance increases at the contact portion between the liquid holding member and the filter reduces, thus assuring the stabilized liquid supply at a large flow rate. If the pitch of the pits and projections is larger than the pitch of the opening of the filter, such pits and projections can be easily provided.

It is preferable that liquid retaining member includes a first liquid retaining member contactable to the filter and a second liquid retaining member, contacted to the first liquid retaining member, for supplying the liquid to the first liquid retaining member, the first liquid retaining member having a liquid retaining force which is larger than a liquid retaining force of the second liquid retaining member. By doing so, the liquid in the liquid container is easily retained around the reception means so that liquid is efficiently supplied from the liquid container.

In this case, by formation of the pits and projections at the contact surface between the first liquid retaining member and the second liquid retaining member, the pits and projections are engaged with the second liquid retaining member pulling, so that possible positional deviation between the first liquid retaining member and the second liquid retaining member is prevented. The first liquid retaining member may be made of fibers, preferably thermoplastic resin material, further preferably polyolefin resin material. If the fiber is made of thermoplastic resin material, the pits and projections are formed by contacting a member having a pattern of pits and projections corresponding to the pits and projections to be formed on the contacts surface of the liquid retaining member to the surface and heating and melting the contacts surface, thus transferring the pit-projection pattern. The fibers constituting the first liquid retaining member may be extended in a direction substantially perpendicular to a direction of contact of the first liquid retaining member to the filter.

According to another aspect of the present invention, there is provided a liquid supplying system comprising a liquid container having therein a liquid retaining member for absorbing and retaining liquid; liquid receiving means for receiving the liquid from said liquid container through a filter contacted to said liquid retaining member, pits and projections are formed on a surface of said liquid retaining member contactable to said filter or on said filter, the liquid retaining member and the filter being out of contact with each other at the pits and being contacted with each other at the projections.

According to the present invention, the contact region between the liquid holding member and the filter is limited because of the presence of the pits and projections on the surface of the liquid holding member relative to the filter. By this, the region where the flow resistance increases at the contact portion between the liquid holding member and the filter reduces, thus assuring the stabilized liquid supply at a large flow rate.

It is preferable that liquid retaining member includes a first liquid retaining member contactable to the filter and a second liquid retaining member, contacted to the first liquid retaining member, for supplying the liquid to the first liquid retaining member, the first liquid retaining member having a liquid retaining force which is larger than a liquid retaining force of the second liquid retaining member. The first liquid retaining member may be made of fibers, preferably thermoplastic resin material, further preferably polyolefin resin material. The liquid container and the liquid receiving means may be separable from each other.

Thus, according to the present invention, a surface of the liquid retaining member or the filter which are contactable to each other is provided with pits and projections which have such sizes that when they are connected, they are contacted to each other at the projections but not contacted at the pits, so that area of the high flow resistance portions are reduced, thus accomplishing stable liquid supply at a high flow rate.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Referring to the accompanying drawings, the preferred embodiment of the present invention will be described.

Figure 1:
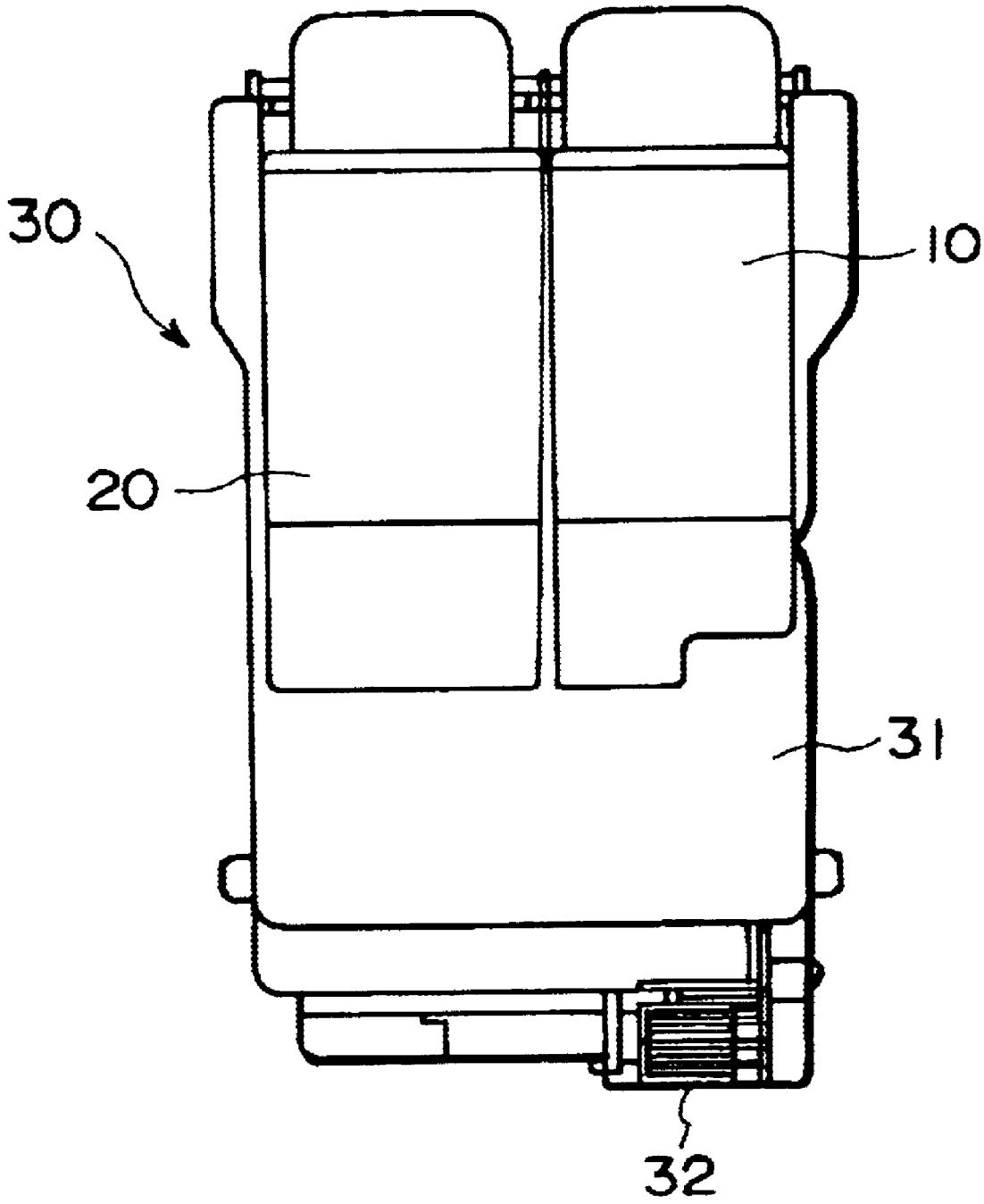
FIG. 1 is a front view of an ink jet cartridge according to an embodiment of the present invention.

FIG. 1 is a front view of an ink jet cartridge according to an embodiment of the present invention. As shown in FIG. 1, the ink jet cartridge 30 comprises a holder 31 which is integral with an ink jet head 32 for ejecting the ink, a black ink container 10 detachably mountable to the holder 31, and a color ink container 20. The black ink container 10 and the color ink container 20 contained the inks to be supplied to the ink jet head 32, the black ink container 10 contains black ink, and the color ink container 20 contains yellow, cyan and magenta color inks.

The ink jet head 32 is disposed at the bottom portion of the holder 31 (in the state-owned use) and is provided with a plurality of groups of ejection outlets (unshown) corresponding to the inks supplied from the black ink container 10 and color ink container 20. The connecting portion of the holder 31 relative to the black ink container 10 and the connecting portion relative to the color ink container 20 are provided with ink receiving tubes (unshown) corresponding to the color inks. The ink receiving tubes are connected with the corresponding groups of the ejection outlets through ink supply passage (unshown).

By mounting the black ink container 10 to the holder 31, the black ink is supplied to the groups of the ejection outlets for the black ink through the black ink ink receiving tube and the ink supply passage. Similarly, by mounting the color ink container 20 to the holder, the color inks in the color ink container are supplied into the corresponding groups of the ejection outlet through the corresponding ink receiving tubes and the ink supply passages. Each of the ink receiving tube is provided at the free end thereof with a filter (unshown) to prevent foreign matter from entering the ink receiving tube, which will be described hereinafter.

Figure 2:
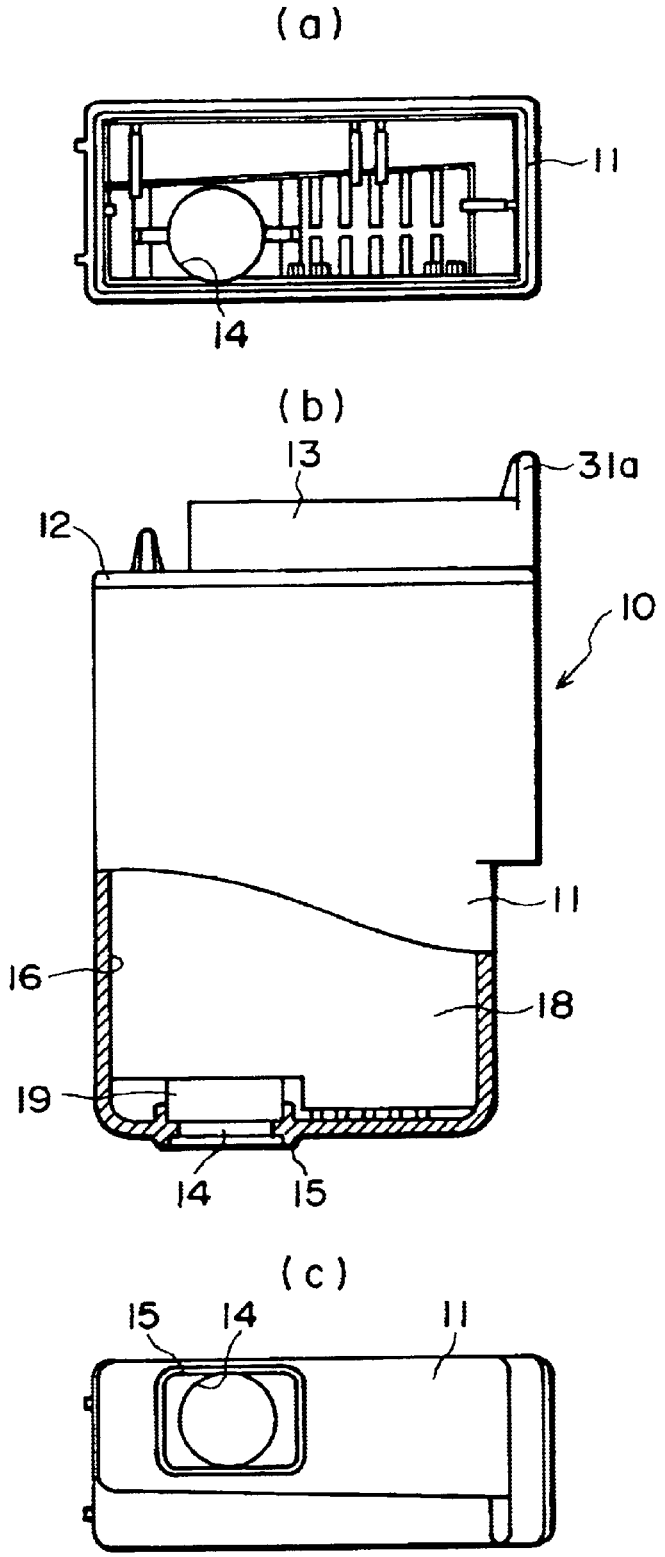
FIG. 2 illustrates a black ink container shown in FIG. 1, and more particularly, a top plan view (a), a partly broken side view (b), and a bottom view (c).

The description will be made as to the black ink container 10 and the color ink container 20. Referring first to FIG. 2, the black ink container 10 will be described. FIG. 2 illustrated a black ink container shown in FIG. 1, and more particularly, a top plan view (a), a partly broken side view (b), and a bottom view (c). In (a) of FIG. 2, the cap member and the ink absorbing material are omitted for simplicity of exportation. The black ink container 10 comprises a casing 11 which constitutes an ink accommodating portion 16 for the black ink and which is open at the upper end, a cap member 12 closing the opening of the casing 11 and having an air vent (unshown) formed therein, an upper member material 13 which covers the air vent of the cap member 12 and which has a buffer space for preventing the ink leaked through the air vent from flowing to the outside. The upper member 13 has an opening (unshown) open to the ambience at a position different from the air vent of the cap member 12 and has a picking portion 13*a* for facilitating mounting and demounting of the holder 31 (FIG. 1). The casing 11 is provided in the bottom portion with an ink supply port 14 at a position opposing into the black ink ink receiving tube of the holder when the black ink container 10 is mounted to the holder 31. Around the ink supply port 14, there is formed a rib 15 for preventing the ink supplied from the black ink container 10 through the ink receiving tube from leaking into the holder 31.

Figure 3:
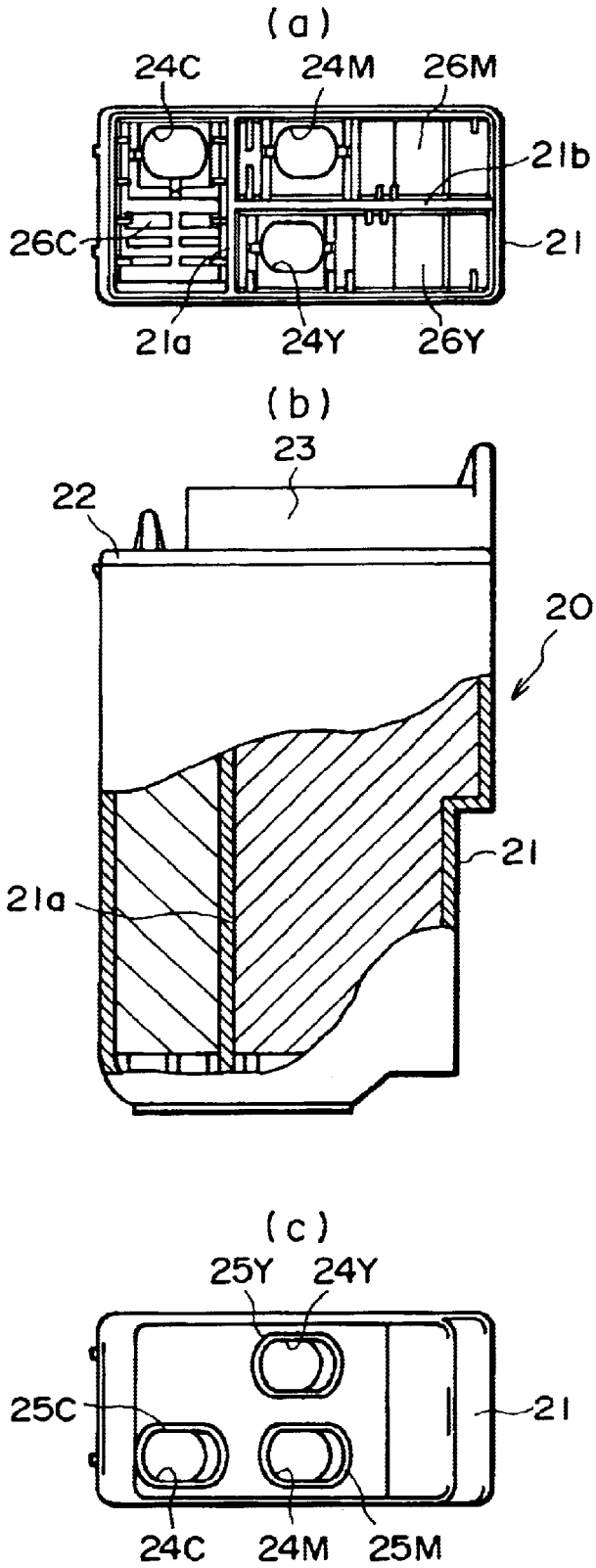
FIG. 3 shows a color ink container shown in FIG. 1, more particularly, a top plan view (a), a partly broken side view (b), and a bottom view (c).

The ink accommodating portion 16 contains therein an ink retaining member 18 for absorbing and retaining the black ink. Between the ink retaining member 18 and the bottom wall of the black ink container 10, there is provided an ink leading member 19 which closes the ink supply port 14 from the inside. The ink leading member 19 absorbs and retains the ink similarly to the ink retaining member 18. Referring to FIG. 3, the color ink container 20 will be described. FIG. 3 shows a color ink container shown in FIG. 1, more particularly, a top plan view (a), a partly broken side view (b), and a bottom view (c). In (a) of FIG. 2, the cap member and the ink absorbing material are omitted for simplicity of exportation. The color ink container 20 has a structure which is fundamentally the same as the black ink container 10 and comprises a casing 21 for accommodating the inks, a cap member 22 having an air vent (unshown), and an upper member 23.

The inside of the casing 21 is partitioned by partition walls 21*a*, 21*b* which constitute a T-shape in a cross-section along a horizontal plane (in the state of use) to divide the inside space into three chambers which corresponds the ink receiving tubes of the holder 31, respectively. The three chambers constitutes an ink accommodating portion 26Y for the yellow ink, an ink accommodating portion 26C for the cyan ink, and an ink accommodating portion 26M for the magenta ink. The air vent of the cap member 22 is provided for each of the ink accommodating portions 26Y, 26C, 26M.

The casing 21 is provided in the bottom portion with ink supply ports 24Y, 24C, 24M at the positions opposed to the respective ink receiving tubes for the color inks when the color ink container 20 is mounted to the holder 31, and around the ink supply ports 24Y, 24C, 24M, ribs 25Y, 25C, 25M for preventing the ink leakage is formed. In each of the ink accommodating portion 26Y, 26C, 26M, there are provided an ink retaining member for absorbing and retaining the ink and an ink leading member, similarly to the black ink container 10 shown in FIG. 2.

The description will be made as to the structure of the ink retaining member and the ink leading member and as to the ink supply operation from the ink container, taking the black ink container 10 for instance. The description applies also to the color ink container 20.

Figure 4:
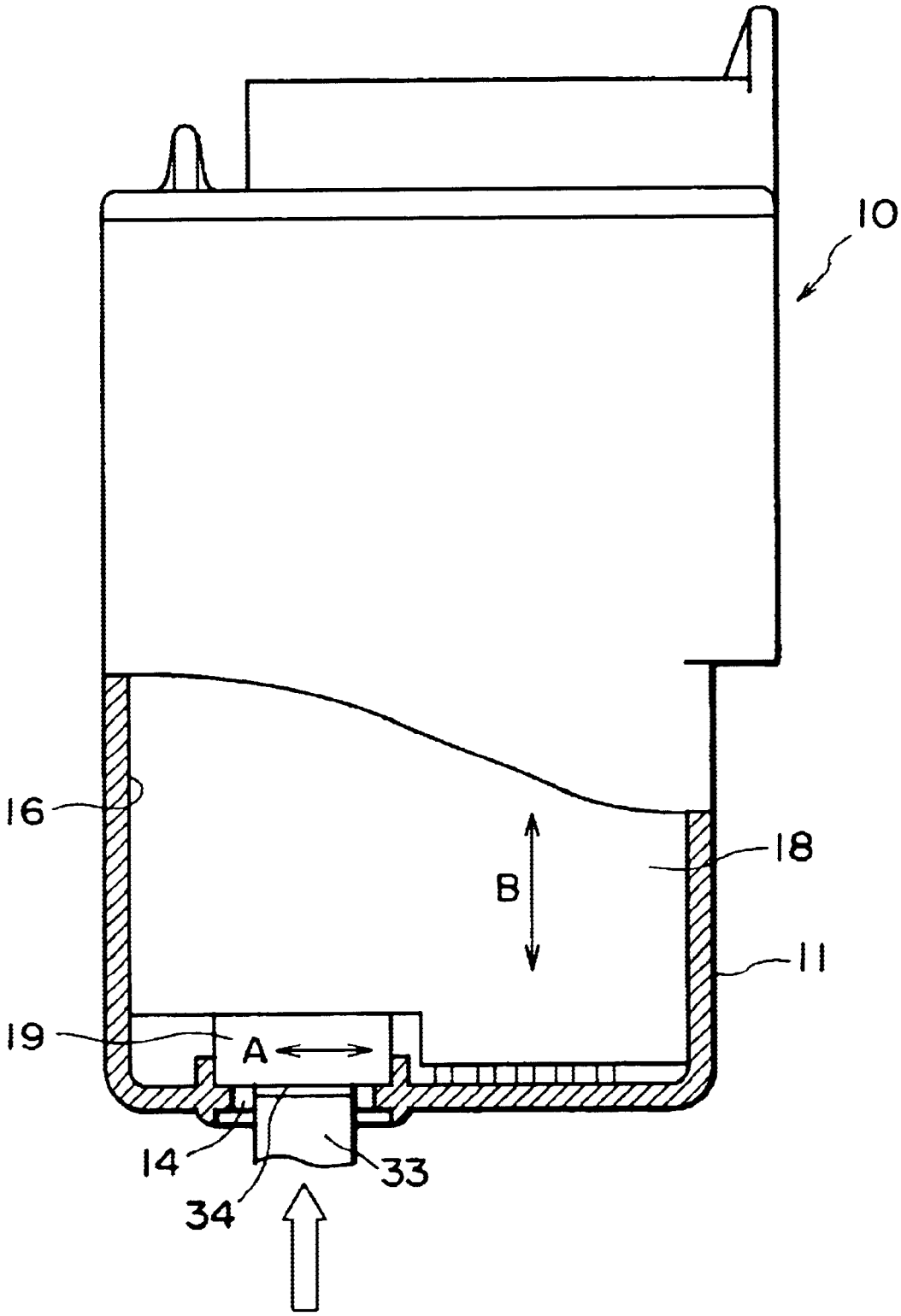
FIG. 4 is a partly broken side view of the black ink container with an ink receiving tube contacted thereto.

As shown in FIG. 4, when the black ink container 10 is mounted to the holder 31 (FIG. 1), a free end portion of the ink receiving tube 33 provided projected from t holder 31 enters the ink supply port 14, and the filter 34 provided at the free end of the ink receiving tube 33 is brought into contact with the ink leading member 19. With the ejection of the ink by the ink jet head 32 (FIG. 1), the ink in the black ink container 10 is supplied through the ink receiving tube 33. In this embodiment, the filter 34 is a stainless steel mesh filter having an effective opening of 8–15 $\mu$m. Here, in order to effectively lead the ink in the black ink container 10, that is, the ink retained in the ink retaining member 18 toward the ink supply port 14, thus enhancing the usability of the ink, the ink leading member 19 has an ink retaining force which is higher than the ink retaining force of the ink retaining member 18. By this, the ink is stably retained adjacent the ink supply port 14 to stabilize the supply of the ink to the ink jet head 32.

In this embodiment, the ink retaining member 18 and the ink leading member 19 are laminations of webs in each of which the fibers of polyolefin thermoplastic resin material are extended substantially unidirectionally. The webs are laminated such that fibers are substantially parallel with each other, and are compressed in the direction of lamination into a fiber aggregate. For the ink retaining member 18, the use is made with fibers having a fineness of 6.7 dtex (diameter of approx. 54 $\mu$m), and the density thereof after the compression is 1.02 g/cm$^3$. As for the ink leading member 19, the use is made with fibers having a fineness of 2.2 dtex (diameter of approx. 18 $\mu$m), and the density later the compression is 0.32 g/cm$^3$. By using the polyolefin thermoplastic resin material as the materials of the ink retaining member 18 and the ink leading member 19, the recycling property and the reuse property are significantly improved it the other parts constituting the black ink container 10 are made of the polyolefin thermoplastic resin materials.

The directions of arrangements of the fibers are substantially perpendicular to the direction of contact to the filter 34 such that ink leading member 19 is further compressed by the contact of the filter 34 (ink receiving tube 33) thereto by which the ink retaining force is enhanced. The large of the ink leading member 19 is such as to permit sliding relative to the casing 11, so that it is easily compressed by the filter 34 contacting thereto. On the other hand, as to the ink retaining member 18, the direction of arrangement of the fibers are parallel (arrow B) with the direction of contact relative to the filter 34 such that ink retaining member 18 is not easily deformed in the direction of contact. The size of the ink retaining member 18 is larger than the inner size of the casing 11 so as to prevent movement in the casing 11.

Figure 5:
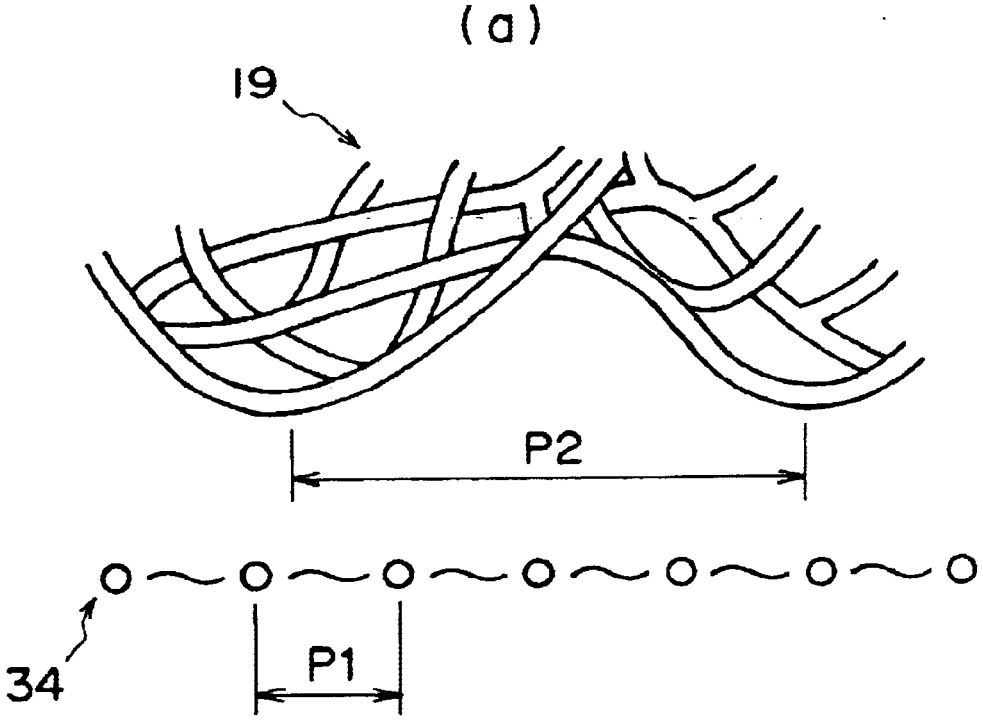
FIG. 5 is an enlarged view of a contact portion between the ink leading member and the filter in the black ink container shown in FIG. 2, more particularly, it shows the states before the contact (a), and after the contact (b).
Figure 5:
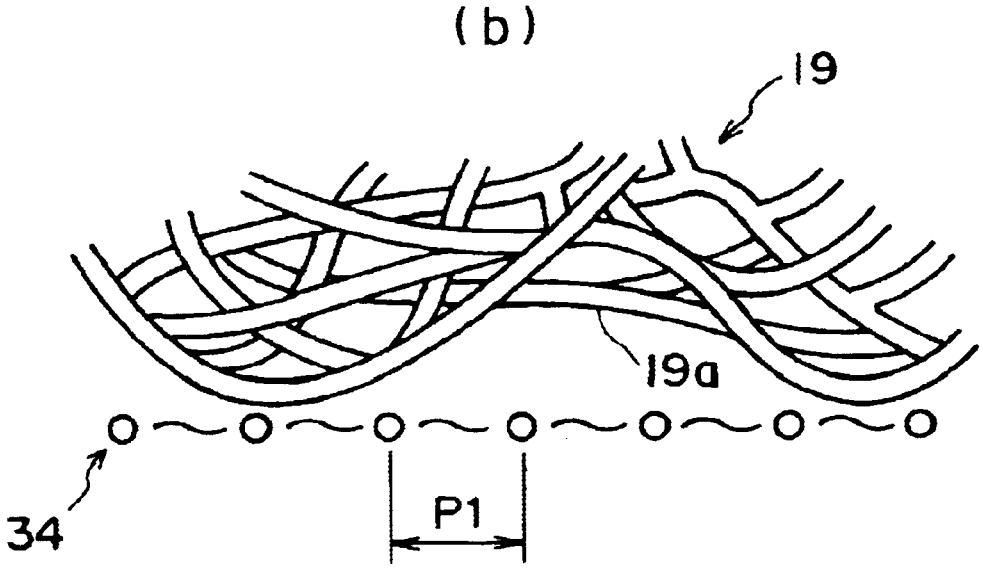
Figure 6:
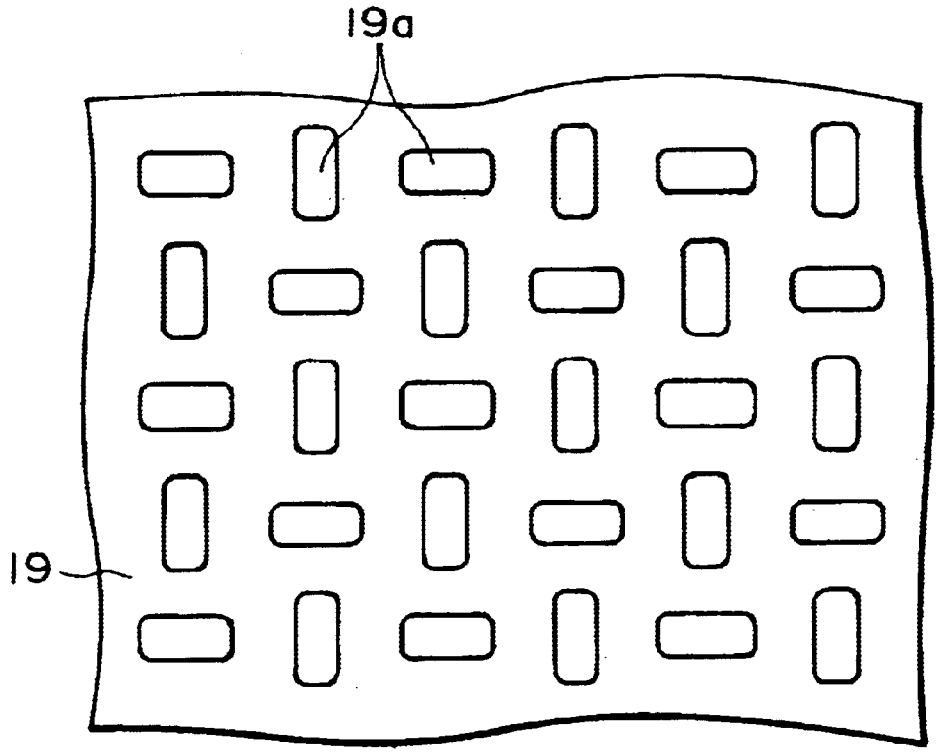
FIG. 6 illustrates a pit-projection pattern of the filter shown in FIG. 4.

The ink supply side surface of the ink leading member 19, that is, the contact surface relative to the filter 34 has pits and projections (concave and convex) as shown in Figure in (a) of FIG. 5. The pitch P2 of the pits and projections formed on the ink supply side surface of the ink leading member 19 is larger than the mesh pitch P1, that is, openings of the filter 34.

The description will be made as to te manufacturing method of the ink leading member 19.

In this embodiment, an ink leading member having a directional property is formed through a web lamination method from fibers of the thermoplastic resin material described above. Then, a Teflon mesh having an average opening of approx. 0.5 mm is contact to an ink supply side end surface of the ink leading member 19, and the region where the Teflon mesh is contacted to the ink leading member 19 is defeated and melted. By doing so, the pattern of the Teflon mesh is transferred on the ink supply side end surface of the ink leading member 19, so that in the pit-projection configuration is formed on the ink supply side end surface of the ink leading member 19. Through the above-described steps, the ink supply side end surface of the ink leading member 19 acquires concavities or pits 19*a*, so that ink supply side end surface of the ink leading member 19 has the pit-projection configuration. In this embodiment, the pitch P2 of the pits and projections as shown in Figure is approx. 0.5 mm. In this manner, the pit-projection configuration can be easily provided on the surface of the ink leading member 19 by the heat molding when the material of the ink leading member 19 is thermoplastic resin material, and the desired pitch and deep of the pits and projections can be provided with high accuracy. Therefore, it is preferable to use thermoplastic resin material as the material of the ink leading member 19, but the present invention is not limited to this material. For example, the pit-projection configuration may be provided by heat molding of a polyurethane foam material.

The ink leading member 19 of this embodiment has a directional nature provided by the web lamination method. Particularly, if the direction in which the filers are extended is perpendicular to the direction of contact of the filter, and the curved portion of the fibers can be positively made convex as shown in FIG. 5. By doing so, the convex portion of the ink retaining member can be assuredly contacted to the filter when it is contacted into the filter, since the projection contactable to the filter has a resiliency. By the firm formation of the pit-projection configuration using the heat molding, the configuration of the pits and projections called the ink leading member is maintained even if it is contacted into the filter. As described in the foregoing, according to the embodiment of the present inventions, the pitch P2 of the pits and projections formed at the ink supply side end surface of the ink leading member 19 is made larger than the mesh pitch P1 of the filter, by which when the filter 34 is contacted or abutted to the ink leading member 19, as shown in (b) of FIG. 5, the pits or concave portions of the ink leading member 19 are not contacted into the filter 34 of the ink leading member 19, but the projections or convex portions are contacted to the filter 34. As a result, the presence of the spaces are assured between the filter 34 and the ink leading member 19. Therefore, the area in which the fibers constituting the ink leading member 19 partly enter the openings of the filter 34, that is, the ink leading member 19 and the filter 34 are contacted with each other too closely, is significantly decreased. In this embodiment, the description has been made particularly on the pitches. As regards the depth provided by the pits and projections is such that spaces are assured between the ink leading member and the ink receiving tube when they are contacted to each other. In this embodiment, the pitches are average pitches. The ink retained in the ink leading member 19 is supplied into the ink receiving tube 33 (FIG. 4) through the opening of the filter 34 through between the fibers constituting the ink leading member 19 in the spaces between the ink leading member 19 and the filter 34. In the space between the ink leading member 19 and the filter 34, the mesh pitch P1 (effective pitch P1) of the filter 34 is substantially the same as that before it is contacted to the ink leading member 19, and therefore, the flow resistance is substantially the same. Thus, by decreasing the area in which the flow resistance increases, the ink can be stably supplied, even when the ink is to be supplied to the ink jet head at a high flow rate in a high speed ink jet recording apparatus.

In this invention, it is desirable that surface of the ink leading member 19 contactable to the filter of the ink receiving tube 33 has a configuration constituting pits and projections, and that configuration is maintained even when the ink leading member 19 is abutted to or press-contacted to the ink receiving tube, more particularly, to the filter. When the ink leading member of the thermoplastic resin material is heated at the surfaces of the fibers, the intersections of the fibers are melted and welded to each other, thus providing firm configurations of pits and projections. Thus, the spaces are assured between the ink leading member and the filter.

The sizes of the openings of the filter 34 and the pits and projections on the ink supply side end surface of the ink leading member 19 are not limited to those given above. As long as the air is not introduced into the gap between the ink leading member 19 and t filter 34, one skilled in the art can easily determines then in consideration of the ink supply property depending on the surface tension, the viscosity of the ink, the wetting property with the ink leading member 19, the wetting property with the filter 34, the required ink flow speed or the like. The materials or the structures of the filter 34, the material of the ink leading member 19 are not limited to the examples described above. For example, the ink leading member 19 may be made of porous material rather than the fiber aggregate. As regards the internal structure of the ink container, the example has been taken in which two ink absorbing materials, namely, the ink retaining member 18 and the ink leading member 19. However, this is not limiting, and the ink absorbing material may be at least contacted to the filter 34 and may comprise one member or three or more members. Moreover, in this embodiment, the ink supply side end surface of the ink leading member 19 has the configuration providing the pits and projections, but the pits and projections may be provided on another surface. For example, the pits and projections may be provided on the contact surface relative to the ink retaining member 18, in which case the ink retaining member 18 is engaged with the pits and projections so that positional deviation between the ink retaining member 18 and the ink leading member 19 can be suppressed. This is desirable from the standpoint of anti-shock property. Furthermore, in such a case, since the contact surface relative to the ink retaining member 18 is a side opposed to the ink supply side end surface of the ink leading member 19, the above-described heating can be carried out while sandwiching the ink leading member 19 with the Teflon mesh when the pits and projections are formed on the ink leading member 19, so that operativity in the formation of the pits and projections is improved. The sizes of the pits and projections formed on the surface other than the ink supply side end surface can be determined irrespective of the openings of the filter 34.

Figure 7:
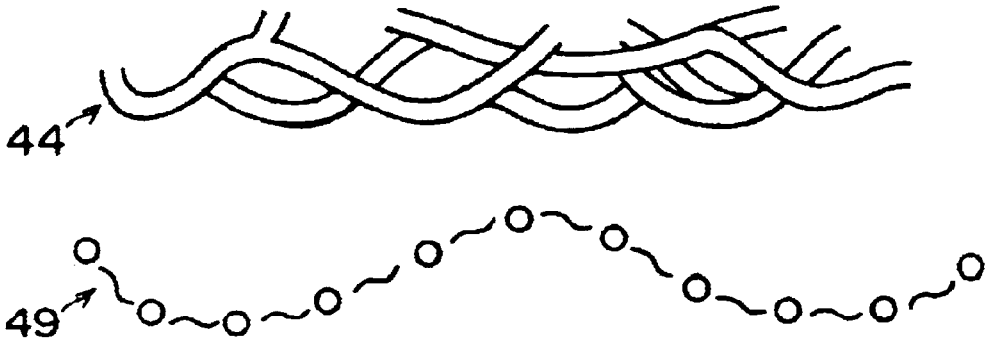
FIG. 7 is an enlarged view of the contact portion between the ink leading member and the filter according to another embodiment of the present invention.
Figure 8:
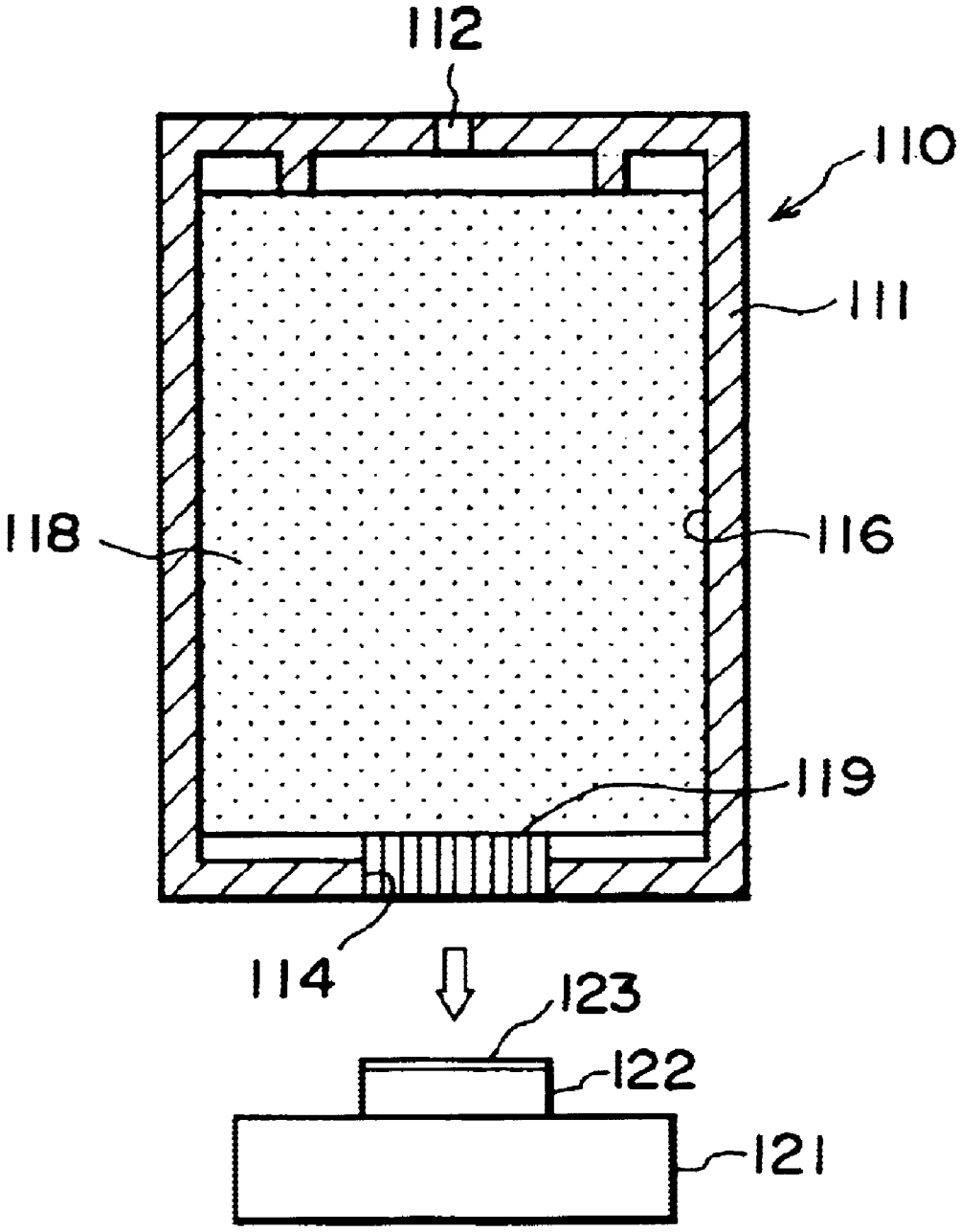
FIG. 8 is a schematic sectional view of a conventional ink container.
Figure 9:
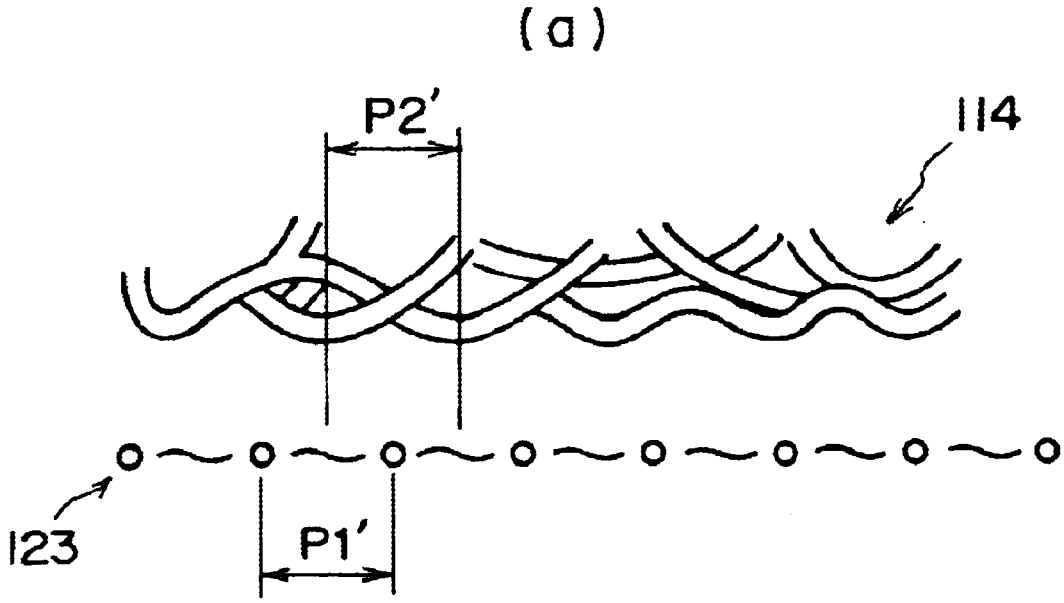
FIG. 9 is an enlarged view of the contact portion between the ink leading member and the filter in the ink container shown in FIG. 8.
Figure 9:
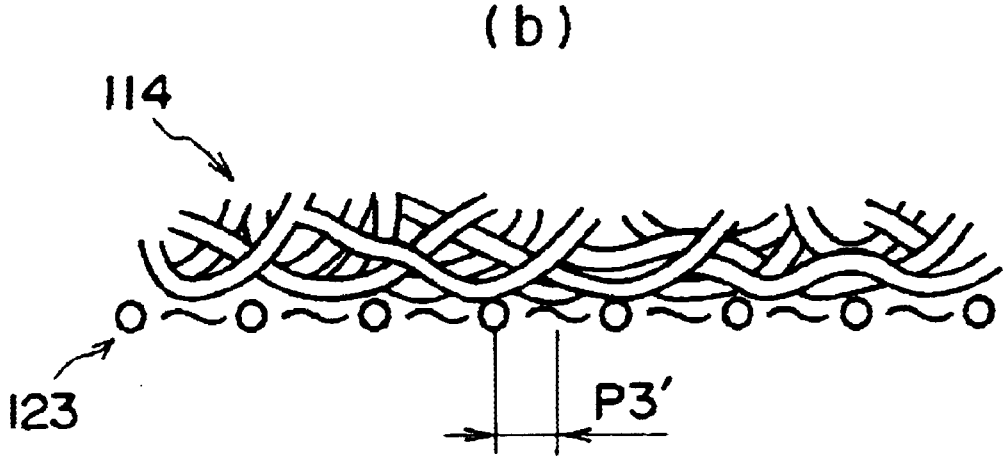

The stabilized ink supply at the high flow rate is accomplished by reducing the area where the filter 34 and the ink leading member 19 are closely contacted to each other. It is not inevitably the ink supply side end surface of the ink leading member 19 that pit-projection configuration is provided. As shown in FIG. 7, the ink supply side end surface of the ink leading member 44 is not subjected to a particular treatment, but the filter 49 is treated for the pit-projection configuration, as shown in FIG. 7. By determining the sizes of the pits and projections such that when the ink leading member 44 and the filter 49 are contacted to each other, the filter 49 is not contacted to the ink leading member 44 at the pits or concave portions of the ink leading member 44, but the projections or the convex portions are contacted. By doing so, the presence of the spaces are assured between the ink leading member 44 and the filter 49 similarly to the foregoing embodiment, so that same advantageous effects are provided. In the foregoing description, the invention is employed in an ink jet recording, and the description has been made particularly on the supply of the ink from the ink container to the ink jet head, but the present invention is applicable to a liquid container and liquid supplying system for liquid other than the ink, when the liquid container has therein an absorbing material for absorbing and retaining the liquid, the absorbing material being contacted to the filter when the liquid is supplied to the outside.

While the invention has been described with reference to the structures disclosed herein, it is not confined to the details set forth and this application is intended to cover such modifications or changes as may come within the purpose of the improvements or the scope of the following claims.

What is claimed is:

1. A liquid container comprising:

a container body;

a liquid retaining member, provided in said container body, for absorbing and retaining liquid therein, said liquid retaining member having a surface to be contacted by a filter provided at a free end of liquid receiving means to supply the liquid to an outside, wherein said surface of said liquid retaining member is provided with a pattern of pits and projections, the pits being out of contact with the filter when said liquid retaining member and the filter are contacted, and wherein the pits and projections are formed by contacting a contact member to said surface of said liquid retaining member and by heating and melting said surface while in contact with the contact member, wherein the contact member has a surface pattern corresponding to the pattern of pits and projections on said surface of said liquid retaining member, thus transferring the surface pattern.

2. A container according to claim 1, wherein a pitch of the pits and projections is larger than a pitch of openings of the filter.

3. A liquid container according to claim 1, wherein said liquid retaining member includes a first liquid retaining member contactable to the filter and a second liquid retaining member, contacted to said first liquid retaining member, for supplying the liquid to said first liquid retaining member, said first liquid retaining member having a liquid retaining force which is larger than a liquid retaining force of said second liquid retaining member.

4. A liquid container according to claim 3, wherein pits and projections are provided on the contact surface of said first liquid retaining member relative to said second liquid retaining member.

5. A liquid container according to claim 3, wherein said first liquid retaining member is made of fibrous material.

6. A liquid container according to claim 5, wherein the fibrous material is thermoplastic resin material.

7. A liquid container according to claim 6, wherein the thermoplastic resin material is polyolefin resin material.

8. A liquid container according to claim 5, wherein fibers constituting said first liquid retaining member are extended in a direction substantially perpendicular to a direction of contact of said first liquid retaining member to the filter.

9. A liquid supplying system comprising:

a liquid container having therein a liquid retaining member for absorbing and retaining liquid; and liquid receiving means for receiving the liquid from said liquid container through a filter contacted to said liquid retaining member, wherein pits and projections are formed on a surface of said liquid retaining member contactable to said filter or on said filter, the liquid retaining member and the filter being out of contact with each other at the pits and being contacted with each other at the projections, and wherein the pits and projections are formed by contacting a contact member to said surface of said liquid retaining member and by heating and melting said surface while in contact with the contact member, wherein the contact member has a surface pattern corresponding to the pattern of pits and projections on said surface of said liquid retaining member, thus transferring the surface pattern.

10. A liquid supplying system according to claim 9, wherein said liquid retaining member includes a first liquid retaining member contactable to the filter and a second liquid retaining member, contacted to said first liquid retaining member, for supplying the liquid to said first liquid retaining member, said first liquid retaining member having a liquid retaining force which is larger than a liquid retaining force of said second liquid retaining member.

11. A liquid supplying system according to claim 10, wherein said first liquid retaining member is made of fibrous material.

12. A liquid supplying system according to claim 11, wherein the fibrous material is thermoplastic resin material having a liquid retaining force which is larger than a liquid retaining force of said second liquid retaining member.

13. A liquid supplying system according to claim 12, wherein the thermoplastic resin material is polyolefin resin material.

14. A liquid supplying system according to claim 9, 10, 11, 12 or 13, wherein said liquid container and said liquid receiving means are separable from each other.

* * * * *